US007977562B2

(12) United States Patent
Qian et al.

(10) Patent No.: US 7,977,562 B2
(45) Date of Patent: Jul. 12, 2011

(54) SYNTHESIZED SINGING VOICE WAVEFORM GENERATOR

(75) Inventors: Yao Qian, Beijing (CN); Frank Soong, Warren, NJ (US)

(73) Assignee: Microsoft Corporation, Redmond, WA (US)

( * ) Notice: Subject to any disclaimer, the term of this patent is extended or adjusted under 35 U.S.C. 154(b) by 367 days.

(21) Appl. No.: 12/142,814

(22) Filed: Jun. 20, 2008

(65) Prior Publication Data

US 2009/0314155 A1 Dec. 24, 2009

(51) Int. Cl.
*G10H 1/06* (2006.01)
*G10L 13/02* (2006.01)

(52) U.S. Cl. ..... 84/622; 704/262; 704/270

(58) Field of Classification Search ..... 84/622; 704/258, 260, 262, 267, 268, 270; 434/307 A
See application file for complete search history.

(56) References Cited

U.S. PATENT DOCUMENTS

| | | | |
|---|---|---|---|
| 5,703,311 | A | 12/1997 | Ohta |
| 5,747,715 | A | 5/1998 | Ohta et al. |
| 6,304,846 | B1 | 10/2001 | George et al. |
| 6,992,245 | B2 | 1/2006 | Kenmochi et al. |
| 7,010,291 | B2 | 3/2006 | Iwanaga |
| 7,016,841 | B2 | 3/2006 | Kenmochi et al. |
| 7,062,438 | B2 | 6/2006 | Kobayashi et al. |
| 2006/0015344 | A1 | 1/2006 | Kemmochi |

FOREIGN PATENT DOCUMENTS

EP 0515709 A1 12/1992

OTHER PUBLICATIONS

Janer, et al. "Performance-Driven Control for Sample-Based Singing Voice Synthesis", Proc. of the 9th International Conference on Digital Audio Effects, Date: Sep. 18-20, 2006, pp. 1-4.
Oliveira, et al. "Tra-la-Lyrics: An Approach to Generate Text Based on Rhythm", Proceedings of the 4th International Joint Workshop on Computational Creativity, Date 2007, 8 pages.
Rodet Xavier "Synthesis and Processing of the Singing Voice", Proc. 1st IEEE Benelux Workshop on Model based processing and coding of Audio, Date: Nov. 15, 2002, pp. 99-108.
Tokuda, et al., "An HMM-Based Speech Synthesis System Applied to English", Proceedings of 2002 IEEE Workshop on Speech Synthesis, 2002, Publication Date: Sep. 11-13, 2002, pp. 227-230.
Saitou, et al., "Vocal Conversion from Speaking Voice to Singing Voice Using Straight", Proceedings Interspeech 2007, Singing Challenge, Date: 2007, 2 pages.

*Primary Examiner* — Jeffrey Donels
*Assistant Examiner* — Andrew R Millikin
(74) *Attorney, Agent, or Firm* — L. Alan Collins; Collins & Collins Incorporated

(57) ABSTRACT

Various technologies for generating a synthesized singing voice waveform. In one implementation, the computer program may receive a request from a user to create a synthesized singing voice using the lyrics of a song and a digital file containing its melody as inputs. The computer program may then dissect the lyrics' text and its melody file into its corresponding sub-phonemic units and musical score respectively. The musical score may be further dissected into a sequence of musical notes and duration times for each musical note. The computer program may then determine a fundamental frequency (F0), or pitch, of each musical note.

17 Claims, 4 Drawing Sheets

SYNTHESIZED SINGING VOICE WAVEFORM GENERATOR

BACKGROUND

Text-to-speech (TTS) synthesis systems offer natural-sounding and fully adjustable voices for desktop, telephone, Internet, and other various applications (e.g., information inquiry, reservation and ordering, email reading). As the use of speech synthesis systems increased, the expectation of speech synthesis systems to generate a realistic, human-like sound capable of expressing emotions also increased. Singing voices that provide flexible pitch control may be used to provide an expressive or emotional aspect in a synthesized voice.

SUMMARY

Described herein are implementations of various technologies for generating a synthesized singing voice waveform. In one implementation, the computer program may receive a request from a user to create a synthesized singing voice using the lyrics of a song and a digital file containing its melody as inputs. The computer program may then dissect the lyrics' text and its melody file into its corresponding sub-phonemic units and musical score respectively. The musical score may be further dissected into a sequence of musical notes and duration times for each musical note. The computer program may then determine the fundamental frequency (F0), or pitch, of each musical note.

Using the database of statistically trained contextual parametric models as a reference, the computer program may match each sub-phonemic unit with a corresponding or matching statistically trained contextual model. The matching statistically trained contextual parametric model may be used to represent the actual sound of each sub-phonemic unit. After all of the matching statistically trained contextual parametric models have been ascertained, each model may be linked with the duration time of its corresponding musical note. The sequence of statistically trained contextual parametric models may be used to create a sequence of spectra representing the sequence of sub-phonemic units with respect to its duration times.

The sequence of spectra may then be linked to each musical note's fundamental frequency to create a synthesized singing voice for the provided lyrics and melody file.

The above referenced summary section is provided to introduce a selection of concepts in a simplified form that are further described below in the detailed description section. The summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

In general, one or more implementations described herein are directed to generating a synthesized singing voice waveform. The synthesized singing voice waveform may be defined as a synthesized speech with melodious attributes. The synthesized singing waveform may be generated by a computer program using a song's lyrics, its corresponding digital melody file, and a database of statistically trained contextual parametric models. One or more implementations of various techniques for generating a synthesized singing voice will now be described in more detail with reference to FIGS. 1-4 in the following paragraphs.

Implementations of various technologies described herein may be operational with numerous general purpose or special purpose computing system environments or configurations. Examples of well known computing systems, environments, and/or configurations that may be suitable for use with the various technologies described herein include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The various technologies described herein may be implemented in the general context of computer-executable instructions, such as program modules, being executed by a computer. Generally, program modules include routines, programs, objects, components, data structures, etc. that perform particular tasks or implement particular abstract data types. The various technologies described herein may also be implemented in distributed computing environments where tasks are performed by remote processing devices that are linked through a communications network, e.g., by hardwired links, wireless links, or combinations thereof. In a distributed computing environment, program modules may be located in both local and remote computer storage media including memory storage devices.

Figure 1:
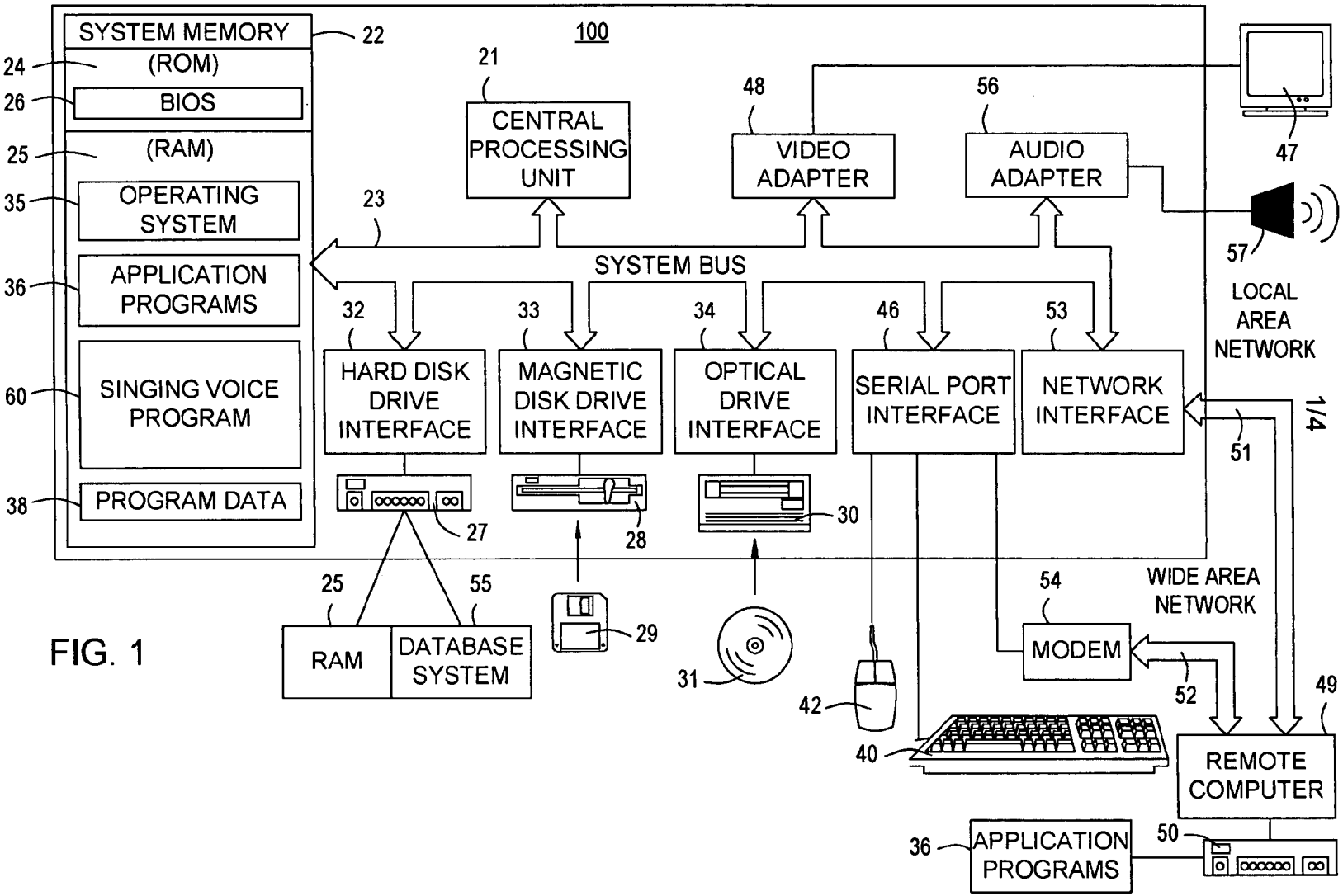
FIG. 1 illustrates a schematic diagram of a computing system in which the various techniques described herein may be incorporated and practiced.

FIG. 1 illustrates a schematic diagram of a computing system 100 in which the various technologies described herein may be incorporated and practiced. Although the computing system 100 may be a conventional desktop or a server computer, as described above, other computer system configurations may be used.

The computing system 100 may include a central processing unit (CPU) 21, a system memory 22 and a system bus 23 that couples various system components including the system memory 22 to the CPU 21. Although only one CPU is illustrated in FIG. 1, it should be understood that in some implementations the computing system 100 may include more than one CPU. The system bus 23 may be any of several types of bus structures, including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus. The system memory 22 may include a read only memory (ROM) 24 and a random access memory (RAM) 25. A basic input/output system (BIOS) 26, containing the basic routines that help transfer information between elements within the computing system 100, such as during start-up, may be stored in the ROM 24.

The computing system 100 may further include a hard disk drive 27 for reading from and writing to a hard disk, a magnetic disk drive 28 for reading from and writing to a removable magnetic disk 29, and an optical disk drive 30 for reading from and writing to a removable optical disk 31, such as a CD ROM or other optical media. The hard disk drive 27, the magnetic disk drive 28, and the optical disk drive 30 may be connected to the system bus 23 by a hard disk drive interface 32, a magnetic disk drive interface 33, and an optical drive interface 34, respectively. The drives and their associated computer-readable media may provide nonvolatile storage of computer-readable instructions, data structures, program modules and other data for the computing system 100.

Although the computing system 100 is described herein as having a hard disk, a removable magnetic disk 29 and a removable optical disk 31, it should be appreciated by those skilled in the art that the computing system 100 may also include other types of computer-readable media that may be accessed by a computer. For example, such computer-readable media may include computer storage media and communication media. Computer storage media may include volatile and non-volatile, and removable and non-removable media implemented in any method or technology for storage of information, such as computer-readable instructions, data structures, program modules or other data. Computer storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium which can be used to store the desired information and which can be accessed by the computing system 100. Communication media may embody computer readable instructions, data structures, program modules or other data in a modulated data signal, such as a carrier wave or other transport mechanism and may include any information delivery media. The term "modulated data signal" may mean a signal that has one or more of its characteristics set or changed in such a manner as to encode information in the signal. By way of example, and not limitation, communication media may include wired media such as a wired network or direct-wired connection, and wireless media such as acoustic, RF, infrared and other wireless media. Combinations of any of the above may also be included within the scope of computer readable media.

A number of program modules may be stored on the hard disk, magnetic disk 29, optical disk 31, ROM 24 or RAM 25, including an operating system 35, one or more application programs 36, a singing voice program 60, program data 38 and a database system 55. The operating system 35 may be any suitable operating system that may control the operation of a networked personal or server computer, such as Windows® XP, Mac OS® X, Unix-variants (e.g., Linux® and BSD®), and the like. The singing voice program 60 will be described in more detail with reference to FIGS. 2-4 in the paragraphs below.

A user may enter commands and information into the computing system 100 through input devices such as a keyboard 40 and pointing device 42. Other input devices may include a microphone, joystick, game pad, satellite dish, scanner, or the like. These and other input devices may be connected to the CPU 21 through a serial port interface 46 coupled to system bus 23, but may be connected by other interfaces, such as a parallel port, game port or a universal serial bus (USB). A monitor 47 or other type of display device may also be connected to system bus 23 via an interface, such as a video adapter 48. A speaker 57 or other type of audio device may also be connected to system bus 23 via an interface, such as audio adapter 56. In addition to the monitor 47, the computing system 100 may further include other peripheral output devices such as printers.

Further, the computing system 100 may operate in a networked environment using logical connections to one or more remote computers, such as a remote computer 49. The remote computer 49 may be another personal computer, a server, a router, a network PC, a peer device or other common network node. Although the remote computer 49 is illustrated as having only a memory storage device 50, the remote computer 49 may include many or all of the elements described above relative to the computing system 100. The logical connections may be any connection that is commonplace in offices, enterprise-wide computer networks, intranets, and the Internet, such as local area network (LAN) 51 and a wide area network (WAN) 52.

When using a LAN networking environment, the computing system 100 may be connected to the local network 51 through a network interface or adapter 53. When used in a WAN networking environment, the computing system 100 may include a modem 54, wireless router or other means for establishing communication over a wide area network 52, such as the Internet. The modem 54, which may be internal or external, may be connected to the system bus 23 via the serial port interface 46. In a networked environment, program modules depicted relative to the computing system 100, or portions thereof, may be stored in a remote memory storage device 50. It will be appreciated that the network connections shown are exemplary and other means of establishing a communications link between the computers may be used.

It should be understood that the various technologies described herein may be implemented in connection with hardware, software or a combination of both. Thus, various technologies, or certain aspects or portions thereof, may take the form of program code (i.e., instructions) embodied in tangible media, such as floppy diskettes, CD-ROMS, hard drives, or any other machine-readable storage medium wherein, when the program code is loaded into and executed by a machine, such as a computer, the machine becomes an apparatus for practicing the various technologies. In the case of program code execution on programmable computers, the computing device may include a processor, a storage medium readable by the processor (including volatile and non-volatile memory and/or storage elements), at least one input device, and at least one output device. One or more programs that may implement or utilize the various technologies described herein may use an application programming interface (API), reusable controls, and the like. Such programs may be implemented in a high level procedural or object oriented programming language to communicate with a computer system. However, the program(s) may be implemented in assembly or machine language, if desired. In any case, the language may be a compiled or interpreted language, and combined with hardware implementations.

Figure 2:
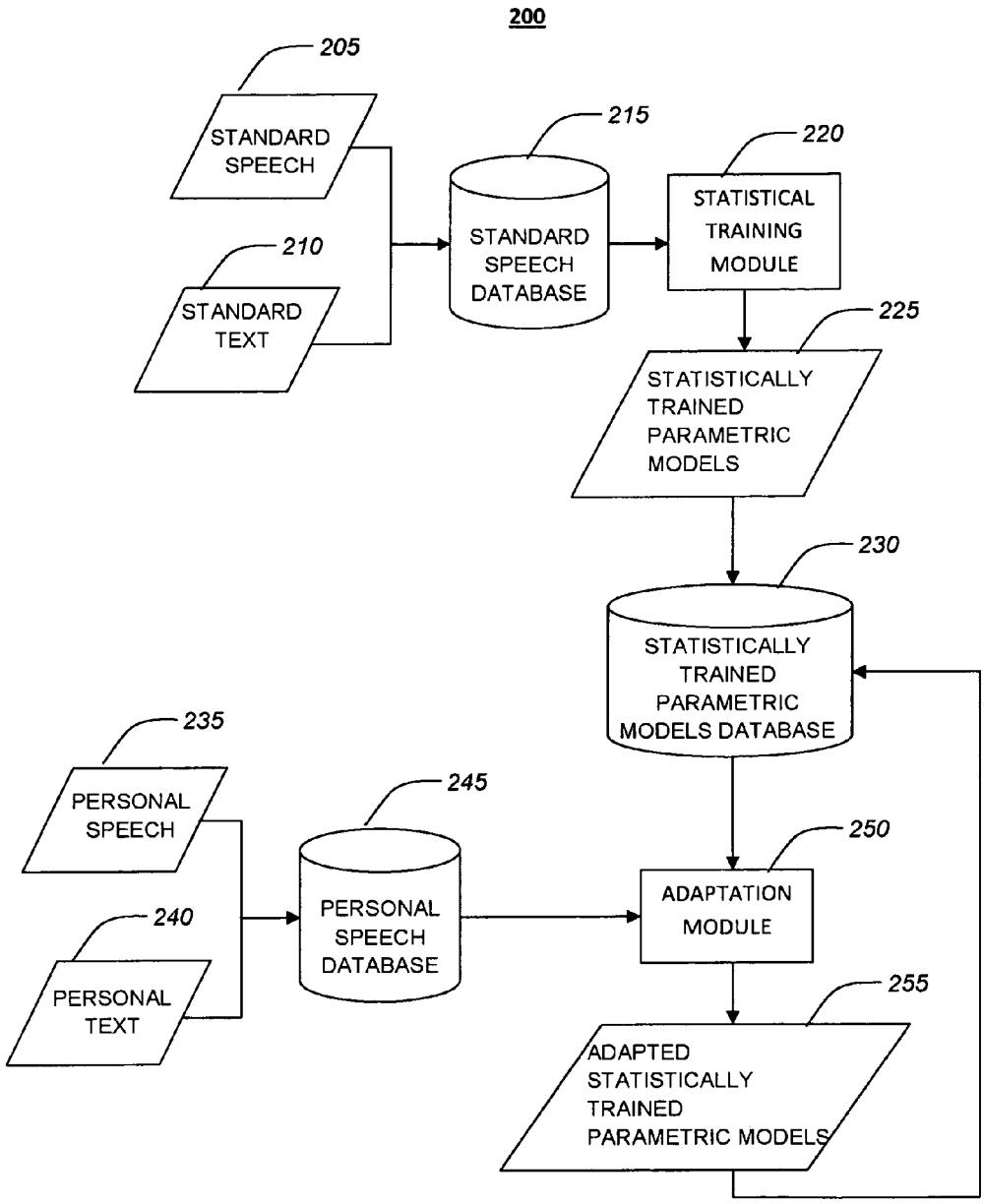
FIG. 2 illustrates a data flow diagram of a method for creating a database of statistically trained parametric models in accordance with one or more implementations of various techniques described herein.

FIG. 2 illustrates a data flow diagram of a method 200 for creating a database of statistically trained parametric models in connection with one or more implementations of various techniques described herein. It should be understood that while the operational data flow diagram 200 indicates a particular order of execution of the operations, in some implementations, certain portions of the operations might be executed in a different order.

In one implementation, statistically trained parametric models 225 may be created by the singing voice program 60. In this case, the singing voice program 60 may use a standard speech database 215 as an input for a statistical training module 220. The standard speech database 215 may include a standard speech 205 and a standard text 210. In one implementation, the standard speech 205 may consist of up to eight or more hours of a speech recorded by one individual. The standard speech 205 may be recorded in a digital format such as a WAV, MPEG, or other similar file formats. The file size of the standard speech 205 recording may be up to one gigabyte or larger. The standard text 210 may include a type-written account of the standard speech 205, such as a transcript. The standard text 210 may be typed in a Microsoft Word® document, a notepad file, or another similar text file format. The standard speech database 215 may be stored on the system memory 22, the hard drive 27, or on the database system 55 of the computing system 100. The standard speech database 215 may also be stored on a separate database accessible to the singing voice program 60 via LAN 51 or WAN 52.

As described earlier, the singing voice program 60 may use the standard speech database 215 as an input to the statistical training module 220. The statistical training module 220 may determine or learn the pitch, gain, spectrum, duration, and other essential factors of the standard speech 205 speaker's voice with respect to the standard text 210.

After the statistical training module 220 dissects the standard speech 205 into these essential factors, a summary of these factors may be created in the form of statistically trained parametric models 225. The statistically trained parametric models 225 may contain one or more statistical models which may be sequences of symbols that represent phonemes or sub-phonemic units of the standard speech 205. In one implementation, the statistically trained parametric models 225 may be represented by statistical models such as Hidden Markov Models (HMMs). However, other implementations may utilize other types of statistical models. The singing voice program 60 may store the statistically trained parametric models 225 on a statistically trained parametric models database 230, which may be stored on the system memory 22, the hard drive 27, or on the database system 55 of the computing system 100. The statistically trained parametric models database 230 may also be stored on a separate database accessible to the singing voice program 60 via LAN 51 or WAN 52.

In one implementation, the size of the statistically trained parametric models database 230 may be significantly smaller than the size of the corresponding standard speech database 215. After the statistically trained parametric models 225 have been stored on the statistically trained parametric models database 230, the singing voice program 60 may match the text input to a corresponding statistically trained parametric model 225 found in database to create a synthesized voice. The voice may be synthesized by a PC or another similar device. The synthesized voice may sound similar to the speaker of standard speech 205 because the statistically trained parametric models 225 have been created based on his voice.

The statistically trained parametric models database 230 may also be used by an adaptation module 250 to create new statistically trained parametric models 225 by adapting the existing statistically trained parametric models 225 to another speaker's voice. This may be done so that the synthesized voice may sound like another individual as opposed to the speaker of standard speech 205.

In one implementation, the singing voice program 60 may use a personal speech database 245 as another input into the adaptation module 250. The personal speech database 245 may include a personal speech 235 and a personal text 240. The personal speech 235 may be obtained from an individual other than the speaker for the standard speech 205. Here, the personal speech 235 may be a recording that is significantly shorter than that of the standard speech 205. The personal speech 235 may consist of ½-1 hour of a recorded speech. The personal speech 205 may be recorded in a digital format such as a WAV, MPEG, or other similar file formats. The personal text 240 may correspond to the personal speech 235 in the form of a transcript, and it may be typed in a Microsoft Word® document, a notepad file, or another similar text file format.

The personal speech database 245 may be stored on the system memory 22, the hard drive 27, or on the database system 55 of the computing system 100. The personal speech database 235 may also be stored on a separate database accessible to the singing voice program 60 via LAN 51 or WAN 52.

The adaptation module 250 may use the personal speech database 245 and the statistically trained parametric models database 230 as inputs to modify the existing statistically trained parametric models 225 to a number of adapted statistically trained parametric models 255. The singing voice program 60 may store the adapted statistically trained parametric models 255 in the statistically trained parametric models database 230.

After the adapted statistically trained parametric models 255 have been added to the existing statistically trained parametric models database 230, the singing voice program 60 may match the adapted models to a text input to create a synthesized voice. The synthesized voice may be heard through speaker 57 or another similar device. In this case, the synthesized voice may sound like the speaker of personal speech 235 because the adapted statistically trained parametric models 255 have been created based on his voice.

Although it has been described that the standard speech database 215, the statistically trained parametric models database 225, and the personal database 245 may have been created or updated by the singing voice program 60, it should be noted that each database may have been created with another program at an earlier time. In case these databases have not been created, the singing voice program 60 may be used to create these databases. Otherwise, the singing voice program 60 may use an existing statistically trained parametric models database 230 to generate a synthesized voice.

Figure 3:
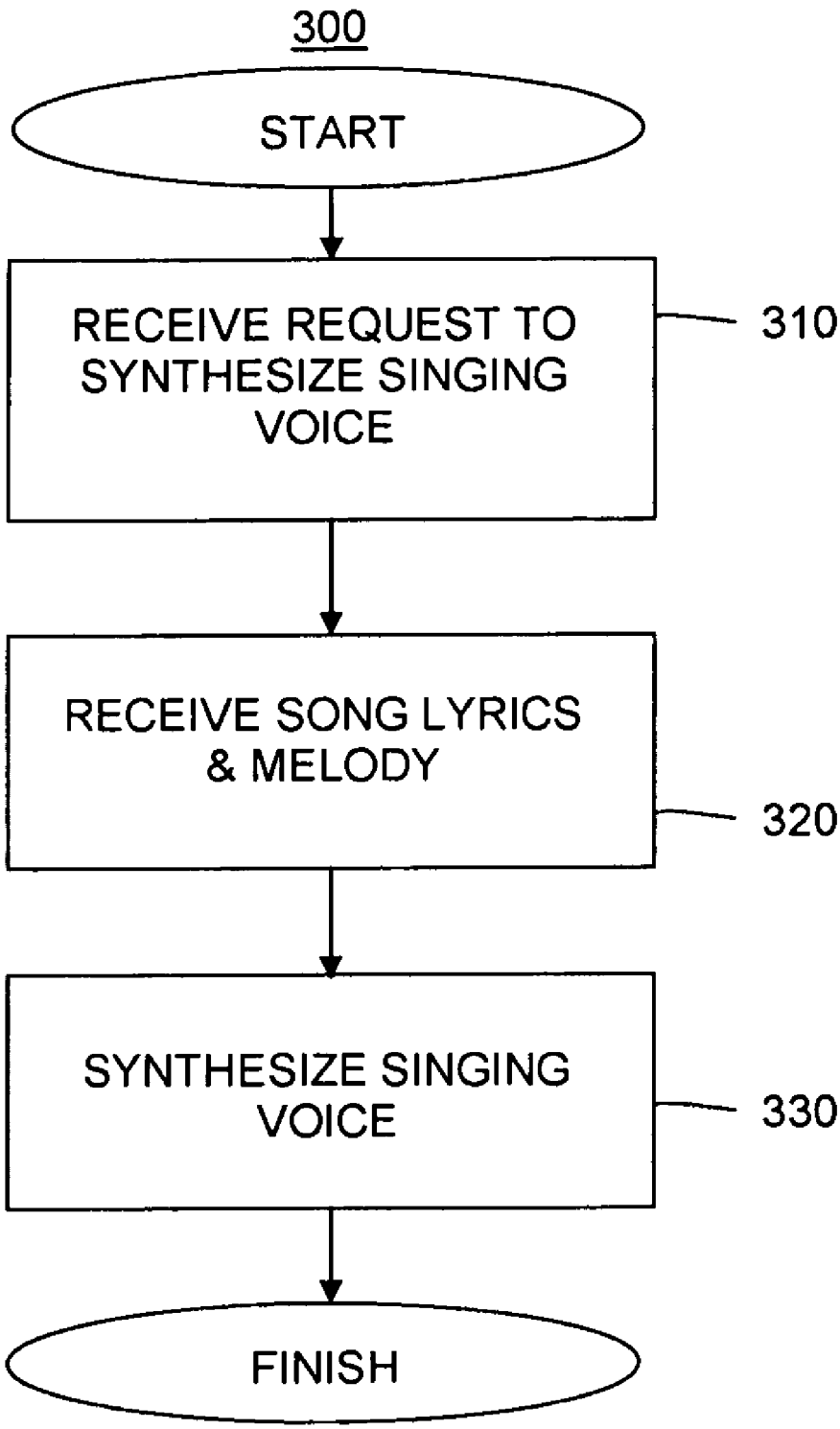
FIG. 3 illustrates a flow diagram of a method for creating a synthesized singing voice in accordance with one or more implementations of various techniques described herein.

FIG. 3 illustrates a flow diagram of a method 300 for creating a synthesized singing voice in accordance with one or more implementations of various techniques described herein.

At step 310, the singing voice program 60 may receive a request from a user to create a synthesized singing voice. In one implementation, the user may make this request by pressing "ENTER" on the keyboard 40.

At step 320, the user may provide the singing voice program 60 a text file containing a song's lyrics. The text file may include a type-written account of the song in a Microsoft Word® document, a notepad file, or another similar text file format. The user may also provide the singing voice program 60 a melody file containing the song's melody. The melody file may be provided in a digital format such as a Musical Instrument Digital Interface (MIDI) file or the like.

At step 330, the singing voice program 60 may begin the process to convert the provided song lyrics and melody into a synthesized singing voice. The process will be described in greater detail in FIG. 4.

Figure 4:
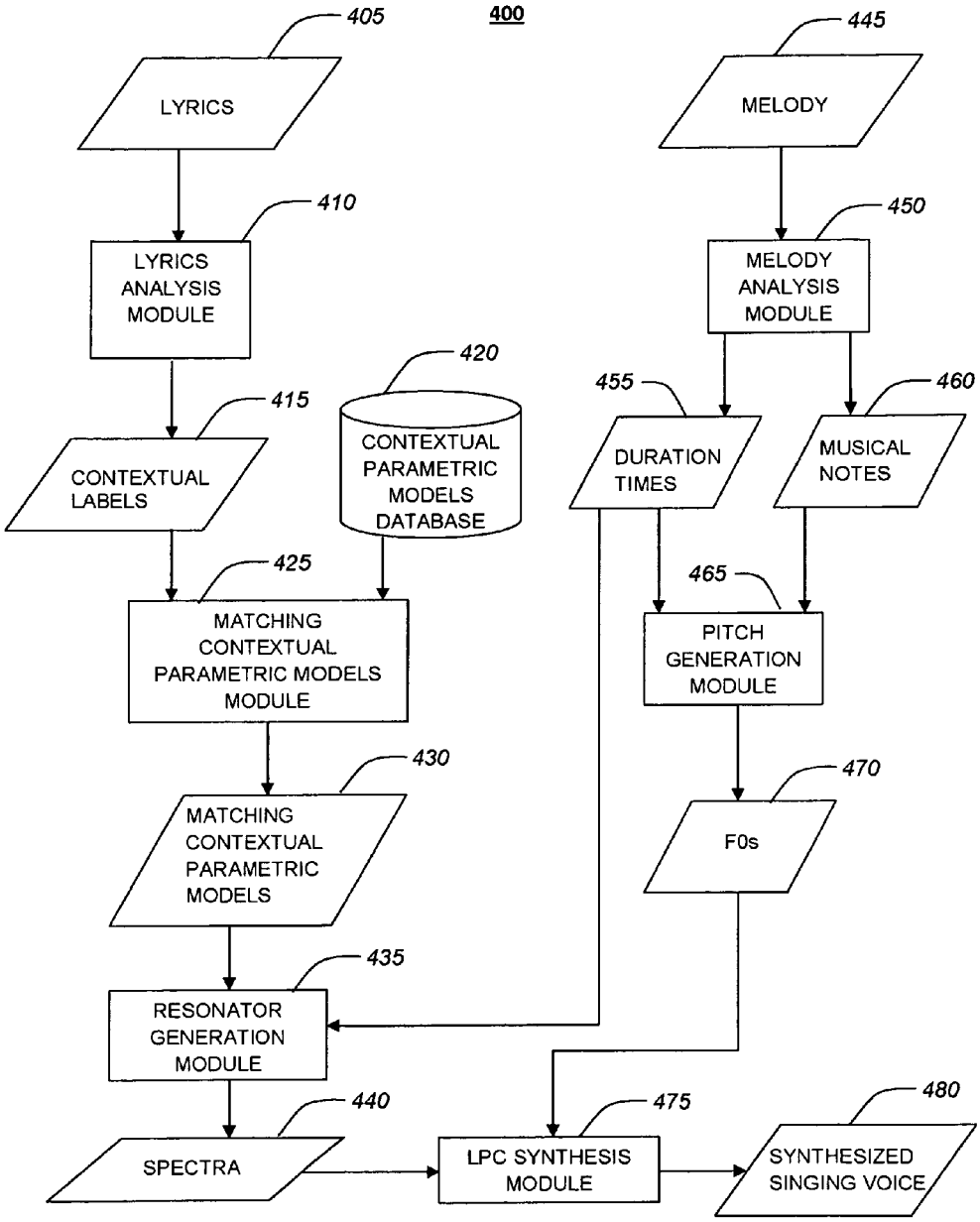
FIG. 4 illustrates a data flow diagram of a method for synthesizing a singing voice in accordance with one or more implementations of various techniques described herein.

FIG. 4 illustrates a data flow diagram 400 for creating a synthesized singing voice in accordance with one or more implementations of various techniques described herein.

The following description of flow diagram 400 is made with reference to method 200 of FIG. 2 and method 300 of FIG. 3 in accordance with one or more implementations of various techniques described herein. Additionally, it should be understood that while the operational flow diagram 400 indicates a particular order of execution of the operations, in some implementations, certain portions of the operations might be executed in a different order.

In one implementation, the singing voice program 60 may use the song's lyrics and its corresponding melody as inputs. The lyrics 405 may be in the form of a text file, such as a type-written account of a song in a Microsoft Word® document, a notepad file, or another similar text file format. The melody 445 of the song may be provided in a digital format such as a Musical Instrument Digital Interface (MIDI) file or the like.

The lyrics 405 may be used as an input by a lyrics analysis module 410. The lyrics analysis module 410 may break down the sentences of the lyrics 405 into phrases, then into words, then into syllables, then into phonemes, and finally into sub-phonemic units. The sub-phonemic units may then be converted into a sequence of contextual labels 415. The contextual labels 415 may be used as input to a matching contextual parametric models module 425. The matching contextual parametric models module 425 may use a contextual parametric models database 420 to find a matching contextual parametric model 430 for each contextual label 415. In one implementation, the contextual parametric models database 420 may include the statistically trained parametric model database 230 described earlier in FIG. 2. In another implementation, the contextual parametric models database 420 may also be adapted with the adaptation module 250 as described in FIG. 2 to synthesize another user's voice.

The matching contextual parametric models module 425 may use a predictive model, such as a decision tree, to find the matching contextual parametric model 430 for the contextual label 415 from the contextual parametric models database 420. The decision tree may search for a contextual parametric model such that the contextual label 415 is used in a similar manner. For example, if the contextual label 415 was the phoneme "ah" for the word "cat," the decision tree may find the matching contextual parametric model 430 such that the phoneme to the left of "ah" is "c" and to the right of "ah" is "t." Using this type of logic, the matching contextual parametric models module 425 may find a matching contextual parametric model 430 for each contextual label 415.

The matching contextual parametric models 430 may then be used as inputs to a resonator generation module 435, along with duration times 455 provided by a melody analysis module 450. The melody analysis module 450 and the duration times 455 will be described in more detail in the paragraphs below.

As explained earlier, the singing voice program 60 may receive a request from a user to create a synthesized singing voice given a song's lyrics 405 and its corresponding melody 445. The melody 445 of the song, typically obtained from a MIDI file, may be used as an input for the melody analysis module 450. The melody analysis module 450 may break down the melody 445 into its musical score. The musical score may be further dissected by the melody analysis module 450 into a sequence of musical notes 460 and the corresponding duration times 455 for each note. The musical notes 460 may contain the actual sequence of musical notes and the prosody parameters of the melody. Prosody parameters generally include duration, pitch and the like. The duration times 455 may typically be measured in milliseconds, but it may also be measured in seconds, microseconds, or in any other unit of time.

At this point, the resonator generation module 435 may then use the matching contextual parametric models 430 and the duration times 455 to create spectra 440. The spectra 440 may be a sequence of multidimensional trajectory representation of the matching contextual parametric models 430 and its corresponding duration times 455. In one implementation, the spectra 440 may be represented in a sequence of LSP (line spectral pairs) coefficients. However, the spectra 440 may also be represented in a variety of other formats other than a sequence of LSP coefficients format.

The duration times 455 obtained from the melody analysis module 450 may also be used as input for a pitch generation module 465, along with the musical notes 460. The pitch generation module 465 may determine the fundamental frequency 470 (F0), or pitch, for each musical note 460 based on the musical notes 460 and the corresponding duration times 455. For example, the MIDI number 36 may correlate to the musical note "C" which may then correlate to a fundamental frequency 470 of 110 Hz.

The duration times 455 may also be attached to each musical note 460 by the pitch generation module 465. As such, a duration time 455 may also be attached to each fundamental frequency 470. The sequence of fundamental frequencies 470 and the spectra 440 may then be used as input to the LPC (linear predictive coding) synthesis module 475 to produce a synthesized singing voice.

The LPC synthesis module 475 may combine the sequence of fundamental frequencies 470 with the spectra 440 of matching contextual parametric models 430 to create a synthesized singing voice 480. The synthesized singing voice 480 may be a waveform of the singing synthesized voice in the time domain. In one implementation, before the LPC synthesis module 475 creates the final waveform, a user may add features to the synthesized singing voice, such as vibrato and natural jittering in pitch to create a more human-like sound. The final waveform may be played on the computing system 200 via speaker 57 or any other similar device.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for creating a synthesized singing voice waveform, comprising:

receiving a request to create the synthesized singing voice waveform;

receiving lyrics of a song and a digital melody file for the lyrics;

determining a sequence of contextual parametric models that corresponds to sub-phonemic units of the received lyrics;

determining a sequence of notes from the received digital melody;

determining a duration time for each of the notes from the received digital melody;

generating a sequence of line spectral pair coefficients from the sequence of contextual parametric models and from the duration times; and synthesizing the synthesized singing voice waveform based on linear predictive coding of the sequence of line spectral pair coefficients and the sequence of notes.

2. The method of claim 1, wherein the lyrics are provided in a text file.

3. The method of claim 1, wherein the digital melody is provided in a file.

4. The method of claim 1, wherein the melody file is in a Musical Instrument Digital Interface (MIDI) format.

5. The method of claim 1, wherein synthesizing the lyrics with the melody comprises:

breaking down words in the lyrics into sub-phonemic units;

converting the sub-phonemic units into a sequence of contextual labels; and determining a matching contextual parametric model for each contextual label, wherein the sequence of contextual parametric models is comprised of the matching contextual model for each contextual label.

6. The method of claim 5, wherein the matching contextual parametric model for each contextual label is determined using a predictive model.

7. The method of claim 5, wherein the matching contextual parametric model for each contextual label is a Hidden Markov Model (HMM).

8. The method of claim 1, further comprising: adding vibrato features and natural jittering in pitch to the synthesized singing voice waveform.

9. A computer system, comprising:

a processor; and a memory comprising instructions that, when executed by the processor, cause the processor to perform a method comprising:

receiving a request to create the synthesized singing voice waveform;

receiving lyrics of a song and a digital melody file for the lyrics;

determining a sequence of contextual parametric models that corresponds to sub-phonemic units of the received lyrics;

determining a sequence of notes from the received digital melody;

determining a duration time for each of the notes from the received digital melody;

generating a sequence of line spectral pair coefficients from the sequence of contextual parametric models and from the duration times; and synthesizing the synthesized singing voice waveform based on linear predictive coding of the sequence of line spectral pair coefficients and the sequence of notes.

10. The computer system of claim 9, wherein the contextual parametric models are each a Hidden Markov Model (HMM).

11. At least one computer storage medium storing computer-executable instructions that, when executed by a computing device, cause the computing device to perform a method comprising:

receiving a request to create the synthesized singing voice waveform;

receiving lyrics of a song and a digital melody file for the lyrics;

determining a sequence of contextual parametric models that corresponds to sub-phonemic units of the received lyrics;

determining a sequence of notes from the received digital melody;

determining a duration time for each of the notes from the received digital melody;

generating a sequence of line spectral pair coefficients from the sequence of contextual parametric models and from the duration times; and synthesizing the synthesized singing voice waveform based on linear predictive coding of the sequence of line spectral pair coefficients and the sequence of notes.

12. The at least one computer storage medium of claim 11, wherein the lyrics are provided in a text file.

13. The at least one computer storage medium of claim 12, wherein the digital melody is provided in a file.

14. The at least one computer storage medium of claim 12, wherein the melody file is in a Musical Instrument Digital Interface (MIDI) format.

15. The at least one computer storage medium of claim 12, wherein synthesizing the lyrics with the melody comprises:

breaking down words in the lyrics into sub-phonemic units;

converting the sub-phonemic units into a sequence of contextual labels; and determining a matching contextual parametric model for each contextual label, wherein the sequence of contextual parametric models is comprised of the matching contextual model for each contextual label.

16. The at least one computer storage medium of claim 15, wherein the matching contextual parametric model for each contextual label is determined using a predictive model.

17. The at least one computer storage medium of claim 15, wherein the matching contextual parametric model for each contextual label is a Hidden Markov Model (HMM).

* * * * *